US005374345A

United States Patent [19]

Owada

[11] Patent Number: 5,374,345

[45] Date of Patent: Dec. 20, 1994

[54] PARTIAL PLATING METHOD FOR A PLATE MEMBER AND MASKING JIG FOR USE THEREIN

[75] Inventor: Hiroaki Owada, Ibaraki, Japan

[73] Assignee: Mitsubishi Nuclear Fuel Co., Tokyo, Japan

[21] Appl. No.: 100,292

[22] Filed: Aug. 2, 1993

[51] Int. Cl.[5] ..... C25D 5/02

[52] U.S. Cl. ..... 205/118; 205/122; 205/136; 204/297 W; 118/500; 118/505

[58] Field of Search ..... 205/118, 122, 136; 204/297 W; 427/282; 118/500, 505

[56] References Cited

U.S. PATENT DOCUMENTS 2,511,128 6/1950 Russell ..... 204/297

5,098,542 3/1992 Reinhart et al. ..... 204/297 W

FOREIGN PATENT DOCUMENTS 820952 9/1959 United Kingdom .

*Primary Examiner*—John Niebling

*Assistant Examiner*—Edna Wong

*Attorney, Agent, or Firm*—Oblon, Spivak, McClelland, Maier & Neustadt

[57] ABSTRACT

A method is provided for partially plating, for example, strip-shaped metallic straps which are parts of a support grid for a nuclear fuel assembly, and further relates to a masking jig for use in the method. The masking jig has a plurality of tubular bodies and a support plate on which the tubular bodies are fixed. A pair of slits is formed in each of the tubular bodies. When carrying out partial plating, a strap is inserted into the slits so that each of the portions of the strap not to be plated are arranged within each of the tubular bodies. By subsequently carrying out plating, a plating layer can be formed on the portions of the strap to be plated, without forming a plating layer on the portions of the strap not to be plated. Moreover, it is possible to prevent any damage from being inflicted to the portions not to be plated due to external force.

10 Claims, 2 Drawing Sheets

PARTIAL PLATING METHOD FOR A PLATE MEMBER AND MASKING JIG FOR USE THEREIN

BACKGROUND OF THE INVENTION

1. Field of the Invention

The present invention relates to a method for carrying out the partial plating of a plate member, such as a strap which is a part of a support grid for nuclear fuel assembly, and relates to a masking jig for use in the method.

2. Background Art

In general, a fuel rod support grid is formed by crossing a plurality of thin tabular Straps, and then brazing together the portions of intersection between the straps. Furthermore, in order to obtain good brazing of the intersecting portions of the straps, it is preferable to perform nickel plating on the sites to be brazed.

However, if nickel is deposited at the contacting portion of an aforementioned strap to a fuel rod, this can lead to embrittlement due to local hydrogenation of a metal tube of the fuel rod. For this reason, utmost control must be exercised to avoid nickel deposition. Accordingly, when performing nickel plating of the aforementioned straps, it is necessary to carry out partial plating such that plating is applied only to the sites to be brazed.

When performing a partial plating by means of electroplating, it has been common practice in the conventional art to cover the portions which are not to be plated by a masking coating or a masking tape, and then, in this state, proceeding with the plating. However, in this case, when removing the masking coating or tape after completion of the plating process, it is necessary to confirm that any silicon, boron or the like, which are included in the masking material, are completely removed. Furthermore, when coating/affixing and removing the masking material, since the spring portions of the strap can be easily deformed, there is a risk that deformation will occur as a result of the application of excessive force. For this reason, this method is problematic in that operations must be carried out with meticulous care.

As a result of various investigations designed to uncover a method wherein partial plating is carried out without using a masking coating or tape, the inventors of the present invention discovered the following phenomena. Namely, the present inventors discovered that, in an electroplating bath, an inner surface of a tubular or a bottle,shaped workpiece is rarely plated except for the region adjacent to the opening thereof as a result of a sharp drop in electric current density inside the a workpiece.

SUMMARY OF THE INVENTION

The present invention is based on the above described knowledge and has as its objectives the provision of a partial plating method for a plate member, wherein the method does not employ a masking coating or tape and by which it is possible to carry out partial plating smoothly and accurately while avoiding the infliction of any damage on the portion not to be plated. The present invention further relates to the provision of a masking jig for use in the method.

In order to achieve the aforementioned objectives, the partial plating method of the present invention has the following steps:

(a) preparing a masking jig having at least one tubular body in which slits are formed;

(b) inserting the plate member in a releasable manner into the slits of the tubular bodies so that each portion of a plate member not to be plated is arranged within each of the tubular bodies and the portion of the plate member to be plated is arranged outside each of the tubular bodies;

(c) performing plating of the plate member by soaking the plate member and the tubular bodies in a plating solution; and (d) freeing the plate member from the masking jig.

In this partial plating method, plating of the plate member is performed in such a manner that each of the portions of the plate member not to be plated is surrounded in a non-contact state by each of the tubular bodies of the masking jig. By this means, it is possible markedly lower the current density on the surface of the portion not to be plated which is within the tubular body, and to prevent plating of the portion not to be plated. Also, since the portion not to be plated can be protected by the tubular body, it is possible to prevent any deformation of this portion due to an external force.

The aforementioned plate member may be a strip shaped metallic strap which is a part of the support grid for a nuclear fuel assembly. In a strap of this type, spring portions and dimple portions, which are the portions not to be plated, are formed at fixed intervals in the longitudinal direction of the strap, and brazing portions, which are the portions to be plated, are formed between each of the portions not to be plated.

When partially plating a strap of this type, a masking jig which has a plurality of tubular bodies is employed. On the circumferential surface of each of the tubular bodies, there is formed a pair of slits so that the slits are diametrically opposed to one another and directed in the axial direction of the tubular body. These tubular bodies are arranged in parallel at a pitch identical to a pitch of the spring portions of the strap. Further, in the above step (b), a strap is inserted passing through the slits of each tubular body, and each portion not to be plated is arranged inside a respective tubular body.

By means of this method, numerous portions of the strap which are not to be plated can all be masked simultaneously.

It is preferable that each of the tubular bodies comprises of a tubular inner circumferential layer formed of an electroconductive material, and an outer circumferential layer formed of an insulating material on the outer circumferential surface of the inner circumferential layer. When using a masking jig of this type, not only is it possible to more accurately prevent the plating of the portions from being plated, but it is also possible to prevent the plating of the external surface of the tubular body. Moreover, it is also possible to increase the current density on the surfaces of the portions to be plated of the plate member which are exposed between each tubular body, and to increase the plating efficiency.

Furthermore, by using a masking jig wherein the opening width of the slit is less than the thickness of the plate member, the plate member can be supported by flexibly inserting it into the slits in step (b). In this case, the affixing and detachment of the plate member is easily accomplished. Further, in the partial plating of a strap, nickle plating is ordinarily carried out in step (c).

The masking jig of the present invention comprises at least one tubular body in which a pair of slits are formed so as to be opposite one another and directed in the axial direction of the tubular body;

wherein the slits have an opening width less than a thickness of the plate member in order to flexibly hold the plate member when the plate member is inserted into the slits, with the portions not to be plated thereof being positioned within the tubular bodies, and the portions to be plated thereof being positioned outside the tubular bodies.

In using a masking jig of this type, the plate member (for example, above-mentioned strap) is first inserted into the slits of the tubular bodies, thereby positioning the portions not to be plated within the tubular bodies and positioning the portions to be plated outside the tubular bodies. In this state, the strap is fixed by the fixing means, and then partial plating is carried out by soaking them in the plating bath. By means of the tubular bodies, the current density on the surfaces of the portions of the strap not robe plated are markedly reduced, thus it is possible to accurately prevent the plating on the portions not to be plated. Also, since the tubular bodies protect the portions not to be plated during the entire plating process, it is also possible to prevent deformation of the portions not to be plated due to external force. Additionally, since the width of the opening of the slits is formed to be less than the thickness of the strap. The attachment and detachment of the masking jig is made simple, and the plating operation can be easily carried out.

Each of the tubular bodieś may comprise a tubular inner circumferential layer formed of an electroconductive material, and an outer circumferential layer formed of an insulating material on an outer circumferential surface of the inner circumferential layer.

Furthermore, when the plate member is a strap used in a support grid, it is preferable that the masking jig have a support body and a plurality of tubular bodies affixed to the support body. These tubular bodies are arranged in parallel at a pitch identical to the disposed pitch of the above-mentioned spring portions. The aforementioned slits formed in the circumferential surface of a tubular body, are arranged in the common plane.

With a masking jig of this type, by merely fixing the strap to the masking jig, numerous portions of the strap not to be plated can be masked at one time, thus making the masking operation more trouble free.

The aforementioned tubular bodies may also be of a cylindrical shape having an external diameter identical to the width of the portions not to be plated.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
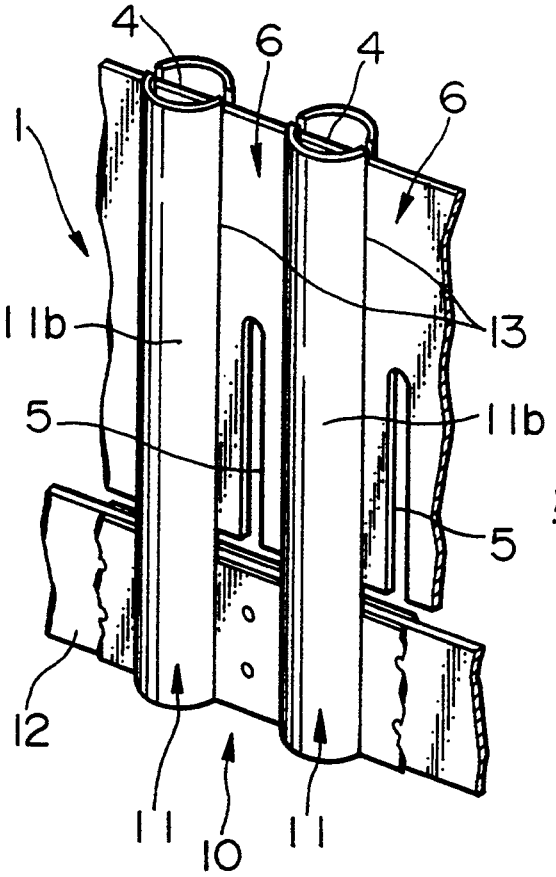
FIG. 1 is a perspective view showing the state wherein one embodiment of the masking jig of the present invention has been affixed to a strap of a support grid.
Figure 2:
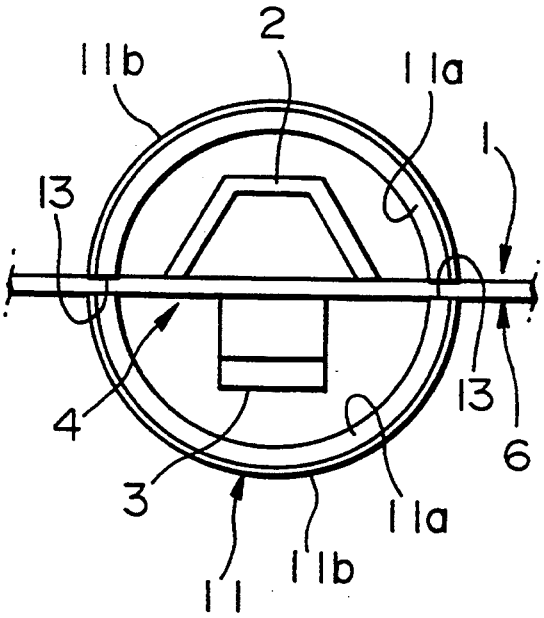
FIG. 2 is a sectional diagram of the portion shown in FIG. 1.
Figure 3:
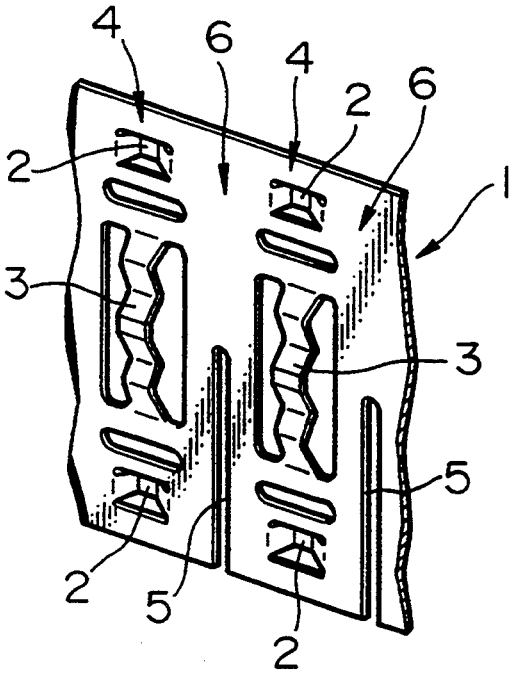
FIG. 3 is a perspective view showing one embodiment of a strap used in a support grid for nuclear fuel assembly.

FIGS. 1 and 2 show an embodiment of the masking jig of the present invention to which the strap (plate member) shown in FIG. 3 the is attached. As is shown in FIG. 3, strap 1 is a thin metallic plate with an elongated rectangular shape. Numerous dimples 2, which are aligned at fixed intervals in the lengthwise direction of the strap 1, are formed in two rows on both sides of strap 1 inn the widthwise direction thereof. These dimples 2 are formed so that they all protrude outward in the same direction. Springs 3 directed in the widthwise direction of the strap 1 are formed between a pair of dimples 2 formed in the widthwise direction of the strap. These springs 3 protrude on the other side the dimples 2.

In this strap 1, the pairs of dimples 2 and the springs 3 are the portions 4 not to be plated, and a slit 5 is situated between each of these respective portions 4 not to be plated. The rectangular areas including the slits 5 are the portions 6 to be plated. When using this strap 1 to produce a support grid, at first, the portions 6 to be plated are plated, and a number of straps 1 are assembled at slits 5 into a lattice form. After aligning the straps 1 into a lattice form, the intersecting plated portions 6 of the straps 1 are brazed together.

Masking jig 10 is comprised of numerous tubular bodies 11 which are mutually disposed in parallel, and a support plate 12 to which the base end of the tubular bodies 11 are affixed. The disposed pitch of the tubular bodies 11 is identical to the pitch of the portions not to be plated on the strap 1. The external diameter of the tubular bodies 11 is identical to the width of the portions 4 not to be plated in the lengthwise direction of the strap 1. Furthermore, the number of tubular bodies 11 is identical to the number of springs 3.

A pair of slits 13 which extend in the axial direction of a tubular body 11 are formed in the front end of each tubular body 11 and facing in the lengthwise direction of the support plate 12. The length of these slits 13 is greater than the width of the strap 1, and the opening width of the slit 13 is slightly more narrow than tile thickness of the strap 1. As a result of this, when strap 1 is inserted into the slit 13, the strap 1 is lightly gripped and held in a detachable manner.

As is shown in FIG. 2, each of the tubular bodies 11 of this embodiment comprises a metallic electroconductive body 11*a* and an insulating coating 11*b* formed on the entire outer surface of the electroconductive body 11*a*. Furthermore, when the support plate 12 is formed of an electroconductive material, it is preferable to also coat the external surface of the support plate 12 with an insulating material.

Figure 4:
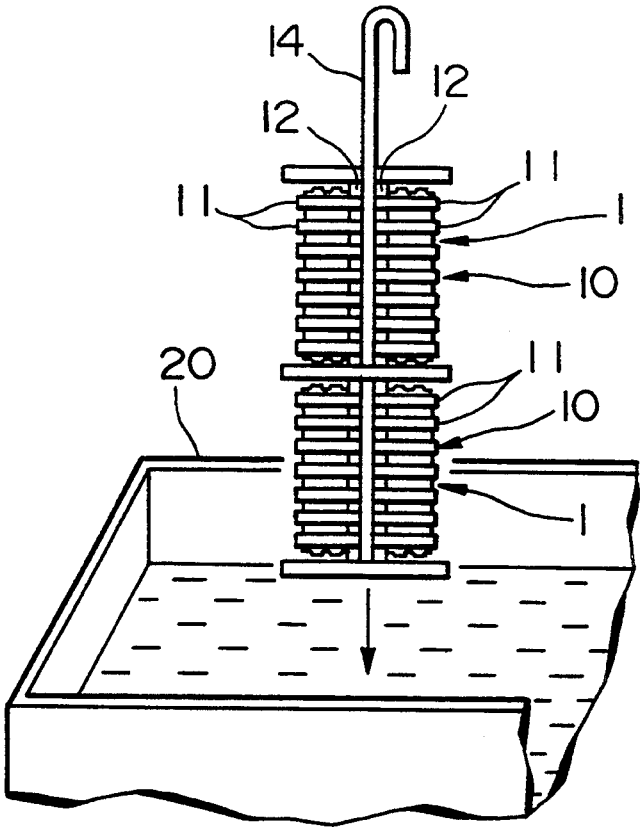
FIG. 4 is an explanatory figure showing the state wherein the strap set to the masking jig of the aforementioned embodiment are soaked in a nickel plating bath.

In carrying out partial plating using the aforementioned masking jig 10, as is shown in FIG. 4, after fixing the masking jig 10 to the jig fixing body 14 (four are fixed in the example in FIG. 4), the strap 1 is inserted into the slits 13 of the tubular bodies 11 so that the positions 4 of the strap 1 not to be plated are positioned inside the tubular bodies 11 of the masking jig 10. As a result, each set of the dimples 2 and the springs 3 of the strap 1 are enclosed by each of the tubular bodies 11 in a non-contact fashion with the inner face of the tubular bodies 11.

Figure 5:
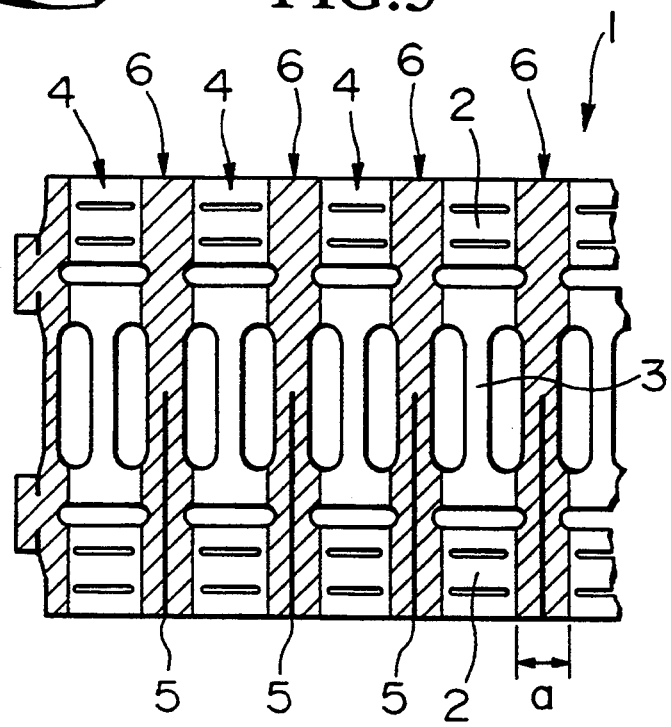
FIG. 5 is a front view showing one embodiment of a partially plated strap.

Next, the jig fixing body 14 is soaked in the nickel plating bath 20. Nickle electrolytic plating is carried out by connecting the strap 1 to the cathode of an electric source, and connecting the anode, which is not shown in the Figures, to the anode of the electric source. The nickel plating is performed on only the portions 6 to be plated (the region approximately 5 mm wide, for example, indicated by the symbol a in FIG. 5) of the strap 1. As a method for supplying an electrical current to the strap 1, the electrical current can be passed through the jig fixing body 14 and the masking jig 10, or another electrical means of transmission can be employed.

With the above described partial plating method, because the portions 4 not to be plated are respectively contained within tubular bodies 11, it is possible to reduce the current density on the surface of the portions 4 not to be plated, and to prevent the deposition of nickle to the dimples 2 and the springs 3, which are the portions 4 not to be plated.

Furthermore, because each tubular body 11 comprises an insulating coating **11*b* formed on the outer surface of the electroconductive body 11*a*, it is possible to prevent the plating on the outer surface of the tubular body 11. Moreover, since the current density on the portions 6 exposed between the tubular bodies 11 is relatively increased by the insulating coating 11*b*, it is possible to improve the plating efficiency of the portions 6** to be plated, and to form a thicker plating layer thereon.

Using a fluorescent X-ray thickness meter, the present inventors measured the plating thickness of a strap which had been obtained by partially plating using the above-mentioned masking jig 10. The results of these measurements revealed that the plating thickness at the non-plated portions 4 was 0~0.04 μm, whereas, the plating thickness at the plated portions 6 was approximately 0.9~2.3 μm. Thus, a remarkable masking effect was confirmed.

Lastly, it is noted that the present invention is not limited to the partial plating of the straps for a support grid, but may also be appropriately applied to all types of plate members for which it is necessary to carry out this type of partial plating.

What is claimed is:

1. A method for partially electroplating an electroconductive plate member having portions not to be plated, the method comprising the steps of:

(a) preparing a masking Jig having at least one tubular body in which a pair of opposing slits terminating at an end of the tubular body are formed and directed in an axial direction of the tubular body;

(b) inserting the plate member in a releasable manner into the slits of the tubular bodies so that each portion of the plate member not to be plated is arranged within each of the tubular bodies and the portion of the plate member to be plated is arranged outside each of the tubular bodies;

(c) soaking the plate member together with the masking jig in an electroplating solution;

(d) performing electroplating of the plate member by supplying electric current between the plate member and an anode contacting the electroplating solution; and (e) freeing the plate member from the masking jig.

2. A method according to claim 1 wherein the plate member is a metallic strip shaped strap which is a part of a support grid for a nuclear fuel assembly, and wherein spring portions and dimple portions are formed as the portions not to be plated and are positioned at fixed intervals in a lengthwise direction of the strap, and wherein the portions to be plated and brazed which extend in the direction of width of the strap are formed between each of the spring portions.

3. A method according to claim 2 wherein the masking jig has a plurality of the tubular bodies which are mutually arranged in parallel at a pitch identical to a pitch of the spring portions in the lengthwise direction of the strap, the slits of the tubular bodies are arranged in a common plane and wherein, in step (b), the strap is inserted along the slits of the tubular bodies so that each of the portions not to be plated are respectively arranged inside each of the tubular bodies.

4. A method according to claim 1, wherein each of the tubular bodies comprises a tubular inner circumferential layer formed of an electroconductive material, and an outer circumferential layer formed of an insulating material on the outer circumferential surface of the inner circumferential layer.

5. A method according to claim 2, wherein nickle plating is carried out in step (c).

6. A method according to claim 2, wherein each of the slits of the tubular bodies has a opening width of less than the thickness of the plate member, and wherein, in step (b), the plate member is flexibly held in the slits of the tubular bodies.

7. A masking jig for partially electroplating an electroconductive plate member having portions not to be plated, which comprises at least one tubular body in which a pair of opposing slits terminating at an end of the at least one tubular body are formed and directed in an axial direction of the tubular body;

wherein the slits have an opening width less than a thickness of the plate member in order to flexibly hold the plate member when the plate member is inserted into the slits, with the portions not to be plated thereof being positioned within the tubular bodies, and the portions to be plated thereof being positioned outside the tubular bodies.

8. A masking jig according to claim 7, wherein each of the tubular bodies comprises a tubular inner circumferential layer formed of an electroconductive material, and an outer circumferential layer formed of an insulating material on an outer circumferential surface of the inner circumferential layer.

9. A masking jig according to claim 7 wherein:

the masking jig has a support body and the at least one tubular body comprises a plurality of tubular bodies which are attached to the support body; the tubular bodies are mutually disposed in parallel with a pitch identical to a pitch of the portions not to be plated; and all the slits formed in the tubular bodies are arranged in a common plane.

10. A masking jig according to claim 7 wherein each of the tubular bodies has a cylindrical shape of an external diameter which is equal to a width of each of the portions not to be plated in a lengthwise direction of the strap.

* * * * *